US009758273B2

(12) United States Patent
Youell et al.

(10) Patent No.: US 9,758,273 B2
(45) Date of Patent: Sep. 12, 2017

(54) HIGH STRENGTH PARTITION BOX ASSEMBLY

(71) Applicant: DRYIP, LLC, Columbus, OH (US)

(72) Inventors: D. Rudolph Youell, Dublin, OH (US); Aaron Spencer, Grove City, OH (US); Michael Fisco, Columbus, OH (US)

(73) Assignee: DRYIP, LLC, Columbus, OH (US)

( * ) Notice: Subject to any disclaimer, the term of this patent is extended or adjusted under 35 U.S.C. 154(b) by 0 days.

(21) Appl. No.: 14/817,121

(22) Filed: Aug. 3, 2015

(65) Prior Publication Data

US 2015/0336707 A1 Nov. 26, 2015

Related U.S. Application Data

(63) Continuation of application No. 14/093,763, filed on Dec. 2, 2013, now Pat. No. 9,096,349.

(60) Provisional application No. 61/790,931, filed on Mar. 15, 2013, provisional application No. 61/810,057, filed on Apr. 9, 2013, provisional application No. 61/810,036, filed on Apr. 9, 2013.

(51) Int. Cl.

| | |
|---|---|
| ***B65D 5/49*** | (2006.01) |
| ***B65D 25/04*** | (2006.01) |
| ***B31B 17/00*** | (2006.01) |
| *B65D 5/32* | (2006.01) |

(52) U.S. Cl.

CPC ..... *B65D 5/48046* (2013.01); *B31B 17/00* (2013.01); *B65D 5/48038* (2013.01); *B65D 25/04* (2013.01); *B31B 2217/103* (2013.01); *B65D 5/324* (2013.01); *B65D 2571/00716* (2013.01)

(58) Field of Classification Search

CPC .. B65D 2571/00716; B65D 2571/0079; B65D 2571/00722; B65D 5/324; B65D 5/48046; B65D 5/48038

See application file for complete search history.

(56) References Cited

U.S. PATENT DOCUMENTS

| | | | | |
|---|---|---|---|---|
| 284,252 A | | 9/1883 | Smith | |
| 449,330 A | | 3/1891 | Perkins | |
| 747,518 A | | 12/1903 | Ward | |
| 1,313,948 A | | 8/1919 | Maegly | |
| 1,767,629 A | * | 6/1930 | Walter | B65D 5/326 229/120 |
| 2,284,385 A | | 5/1942 | Freshwaters | |
| 2,448,795 A | | 5/1946 | Grecco | |
| 2,706,935 A | | 4/1955 | Pasjack | |
| 2,709,547 A | | 5/1955 | Niedringhaus | |

(Continued)

FOREIGN PATENT DOCUMENTS

| | | |
|---|---|---|
| FR | 1417280 | 10/1965 |
| WO | 2011010242 A1 | 1/2011 |

*Primary Examiner* — Anthony Stashick
*Assistant Examiner* — Mollie Impink
(74) *Attorney, Agent, or Firm* — Standley Law Group LLP

(57) ABSTRACT

The present invention is a divider box assembly comprising a plurality of individual compartments formed from a plurality of transverse, longitudinal panels and exterior panels. Such exterior panels arranged such that they may form high strength internal and external partitions to support stacking of a plurality of divider boxes and also providing increased resistance to rough handling during shipment and storage.

6 Claims, 7 Drawing Sheets

(56) References Cited

U.S. PATENT DOCUMENTS

| | | | | |
|---|---|---|---|---|
| 3,880,343 | A * | 4/1975 | Rockefeller | B65D 5/4804 229/120.02 |
| 3,900,157 | A | 8/1975 | Roth | |
| 3,942,709 | A | 3/1976 | Gepfer | |
| 4,572,425 | A | 2/1986 | Russell | |
| 5,004,146 | A * | 4/1991 | Thominet | B65D 5/48048 229/120.31 |
| 5,150,546 | A | 9/1992 | Tucker | |
| 5,671,857 | A | 9/1997 | Stromberg | |
| 5,785,239 | A | 7/1998 | Campbell, II et al. | |
| 6,196,449 | B1 * | 3/2001 | Chen | B65D 5/4804 229/120.26 |
| 6,669,082 | B1 | 12/2003 | Meyer | |
| 6,814,232 | B1 | 11/2004 | Morris et al. | |
| 7,455,214 | B2 | 11/2008 | Miller et al. | |
| 7,775,419 | B2 | 8/2010 | Bale | |
| 9,096,349 | B2 | 8/2015 | Youell et al. | |
| 2003/0222129 | A1 | 12/2003 | Williams | |
| 2009/0272792 | A1 | 11/2009 | Yang et al. | |
| 2012/0223129 | A1 | 9/2012 | Oppenheimer | |

* cited by examiner

HIGH STRENGTH PARTITION BOX ASSEMBLY

CROSS-REFERENCE TO RELATED APPLICATION

This application is a continuation of patent application Ser. No. 14/093,763, which claims priority to provisional applications 61/790,931 filed on Mar. 15, 2013, 61/810,057 filed on Apr. 9, 2013 and 61/810,036, filed on Apr. 9, 2013. All of the above applications are incorporated by reference in their entirety as if fully recited herein.

STATEMENT REGARDING FEDERALLY SPONSORED RESEARCH

Not applicable.

BACKGROUND AND SUMMARY OF THE INVENTION

The present disclosure relates generally to paperboard containers, and more particularly to divider box and assembly.

Existing divider systems are primarily for providing internal dividers within the box container perimeter. The dividers may be formed of interlocking sheets. The interlocking sheets commonly comprise interior divided cells, and perimeter cells that are open around the perimeter of the divider. Alternatively, interlocking divider partitions do not delineate a complete perimeter cell, but provide for an abbreviated perimeter cell that functions as an air cell around the perimeter of the divider.

These perimeter air cells result in a waste of a significant portion of the box container volume, and add weight to the divider system that does not provide for additional item cells. Heavy items carried in the interior cells in such designs may shift and collapse the perimeter air cells, allowing additional shifting of the contents of the box container. Shifting can cause impact damage or lead to the collapse of a stack of box containers.

In view of the foregoing, an improved divider box assembly is needed, particularly in improvement in the strength of the box containers to allow for stacking with less risk of collapse.

In an embodiment of the invention, a divider box may contain a plurality of individual compartments. Such an embodiment may comprise a series of substantially parallel transverse panels. Each transverse panel having a top edge, a bottom edge, and a pair of side edges. The transverse panels have a series of slots extending from the bottom edge of each transverse panel upwardly. Each transverse panel may have a folded tab at each side edge thereof. The divider box may also include a series of substantially parallel longitudinal panels. Each longitudinal panel has a top edge, a bottom edge, and a pair of side edges. The transverse panels may have one or more slots extending from the top edge of each transverse panel downwardly. The transverse panels and the longitudinal panels may be perpendicularly disposed with the transverse panel slots being placed within the longitudinal panel slots to create a crate of individual compartments. The divider box also has at least a pair of exterior panels. Each exterior panel has a top edge, a bottom edge, and a pair of side edges. The exterior panels may be formed from a material similar to that of the transverse and longitudinal panels or may be formed from a material having a higher resistance to deformation. These exterior panels may surmount the transverse and longitudinal panels, forming an outside surface of the divider box. Each folded transverse panel tab may be joined to the exterior panels. The divider box may also comprise a lid and a bottom tray.

BRIEF DESCRIPTION OF THE DRAWINGS

For a fuller understanding of the nature and advantages of the present method and process, reference should be had to the following detailed description taken in connection with the accompanying drawings, in which.

The drawings will be described in further detail below.

DETAILED DESCRIPTION

Figure 1:
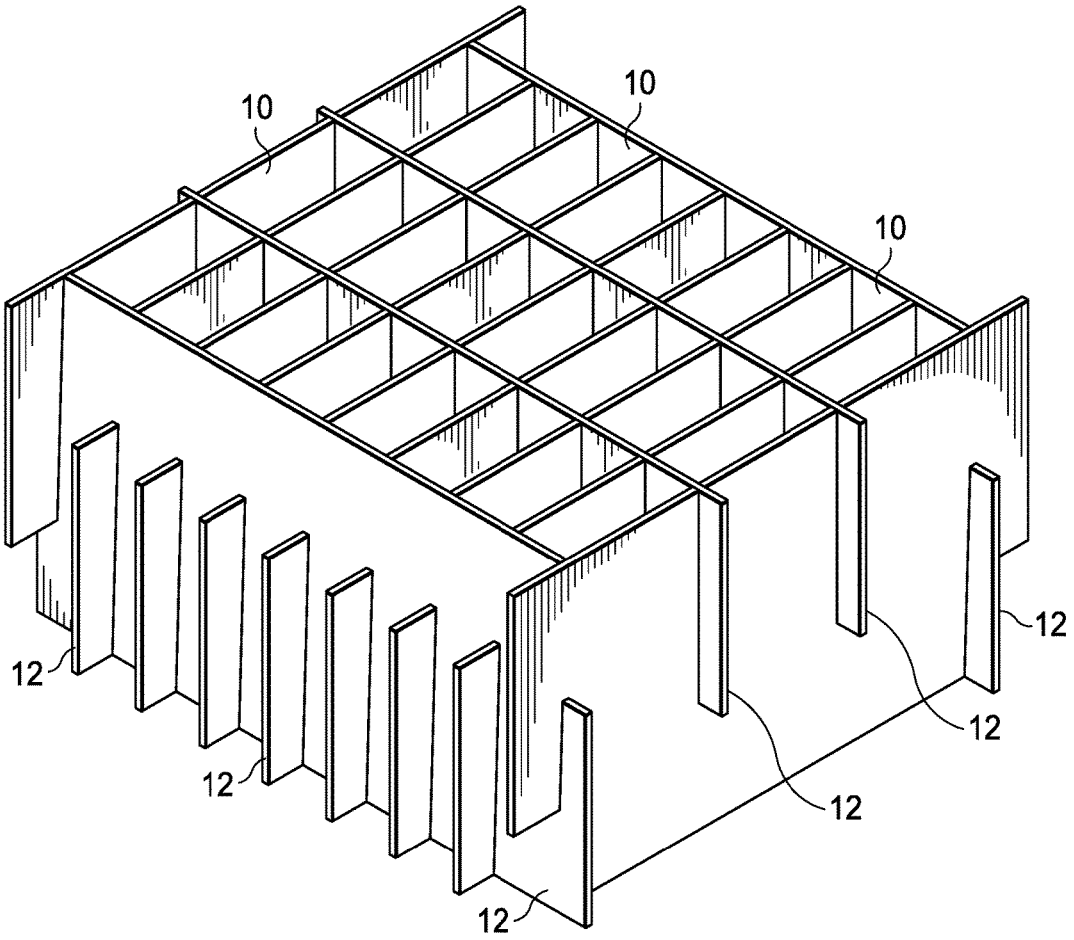
FIG. 1 (PRIOR ART)
FIG. 1 is an isometric view of a known embodiment of divider box insert.

FIG. 1 illustrates a known embodiment of a divider box. As was described above, such designs require partition sections 10 that extend past the walls of the outer partitions formed by those partition sections. These extensions 12 result in an unused portion of the enclosure. Not only does this reduce the usable space within the divider box, it doesn't provide any support or strength to the divider box walls.

The disclosed divider box assembly may be useful in shipping individual component parts in individual compartments so as to prevent damage by the parts, for example, by bumping against each other during shipment. The disclosed divider box assembly can be shipped in a relatively flat, folded down configuration and then unfolded at the plant for stuffing with parts. The entire volume of the divider box may be used for storing component parts inasmuch as compartments fill the entire interior volume of the divider box.

Figure 2:
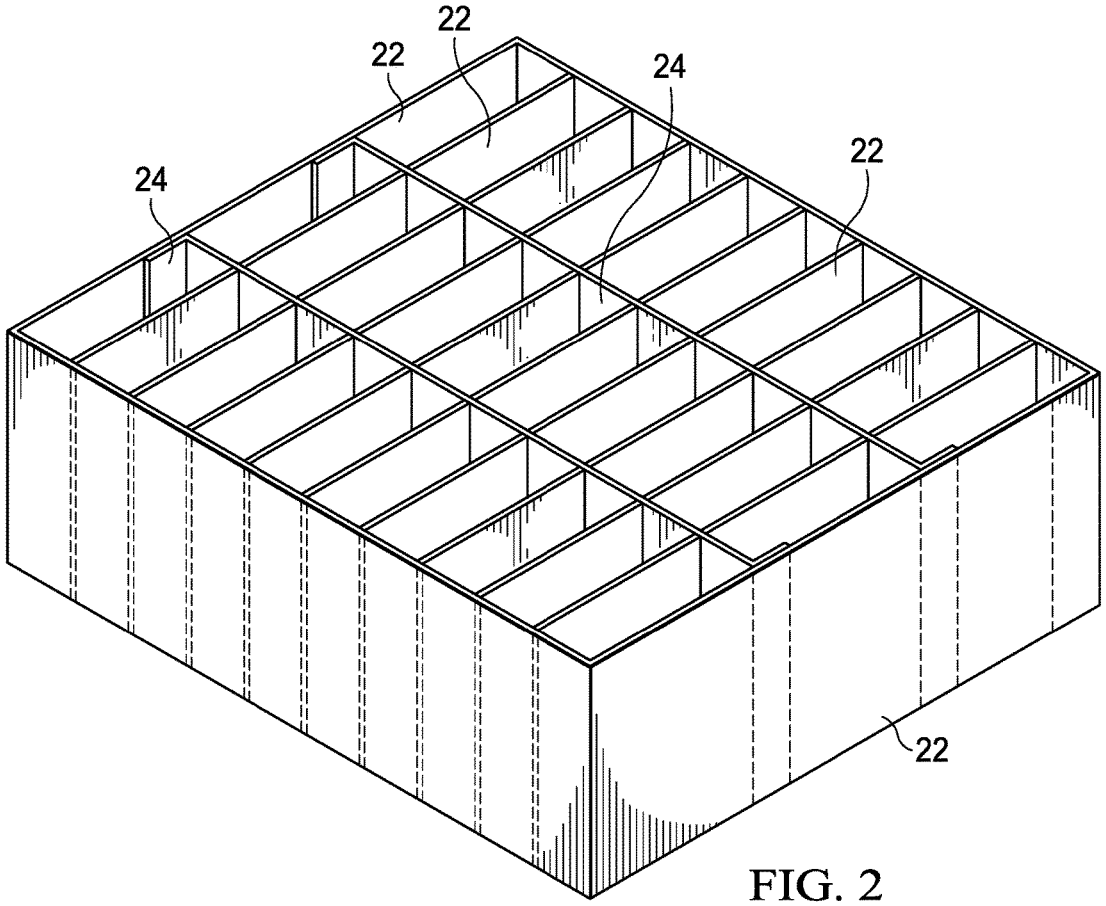
FIG. 2 is an isometric view of an embodiment of the disclosed divider box formed without exterior panels.
Figure 3:
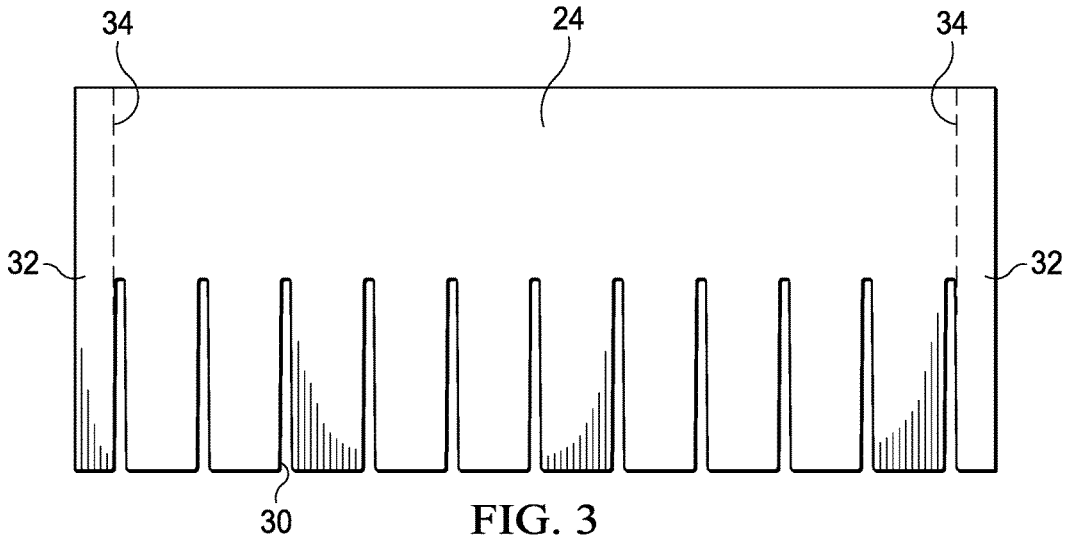
FIG. 3 is a plan view of a longitudinal panel according to an embodiment of the invention.
Figure 4:
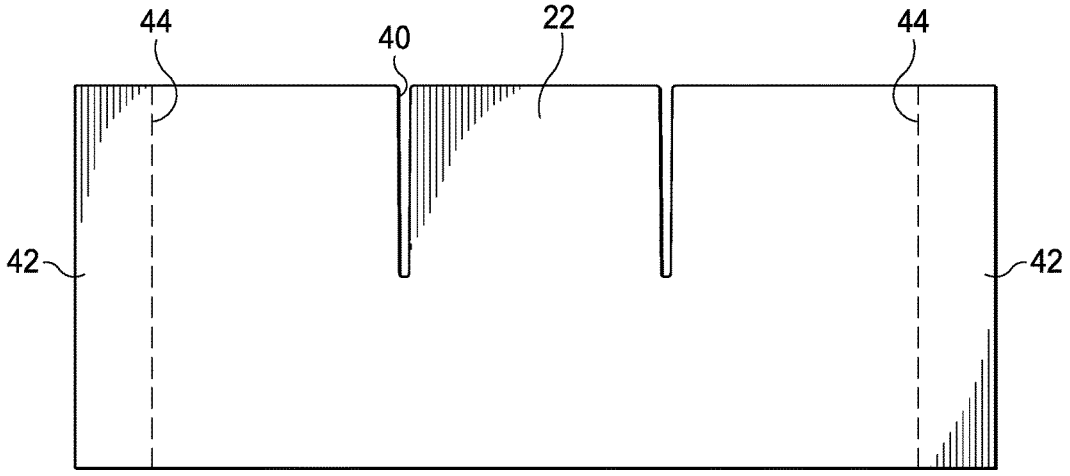
FIG. 4 is a plan view of a transverse panel according to an embodiment of the invention.
Figure 5:
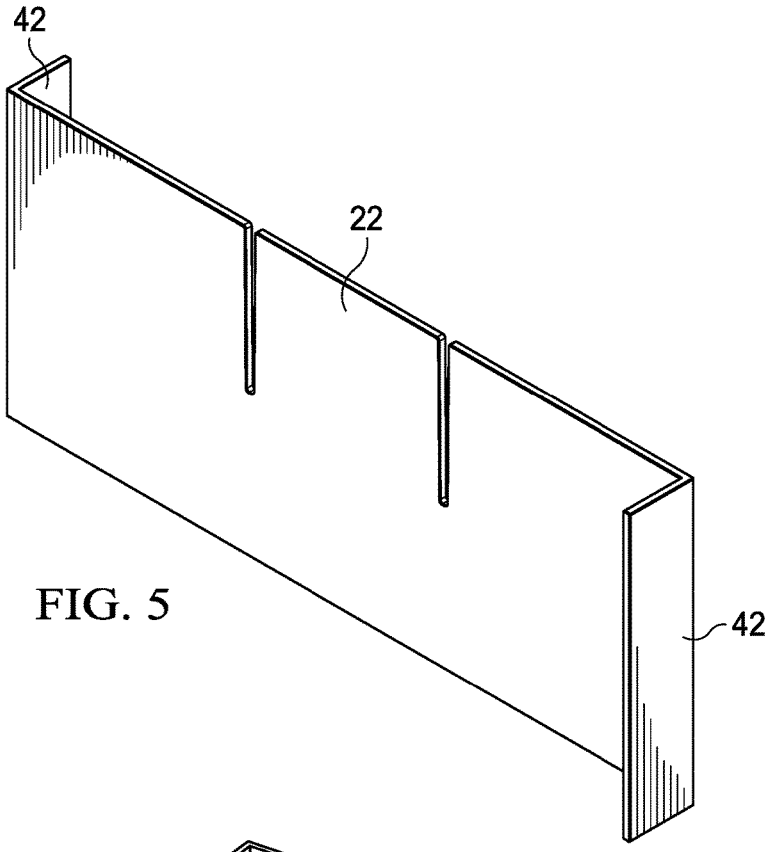
FIG. 5 is an isometric view of an embodiment of a transverse panel according to an embodiment of the invention showing tabs formed at the ends of said panel.

Referring to FIG. 2, a divider box assembly according to an embodiment of the invention 20 may be comprised of a plurality of longitudinal panels 22 and transverse panels 24. FIG. 3 illustrates an embodiment of a longitudinal panel 24. As illustrated, the longitudinal panel comprises a series of slots 30 extending from the bottom of the panel, upward to about half the distance of the panel. FIG. 4 illustrates an embodiment of a transverse panel 22. The transverse panel has series of slots extending downward from the top edge of the panel. Referring again to FIG. 2, these panels may be placed at right angles to one another and the slots inserted into each other so as to form the divider assembly of FIG. 2. As is illustrated in FIG. 3, each longitudinal panel may also comprise tabs 32, formed along bend lines 34 located at the ends of the panel. Similarly, a transverse panel may also comprise tabs 42 located similarly along bend lines 44 at the ends of the panel. Referring to FIG. 5 which illustrates a transverse panel 22, the tabs 42 may be bent at an approximately 90 degree angle from the panel. The number of slots (30 and 40) and the number of longitudinal panels 24 and transverse panels 22 show in the figures references herein is by way of illustration and not intended to be a limitation of the invention.

Figure 6:
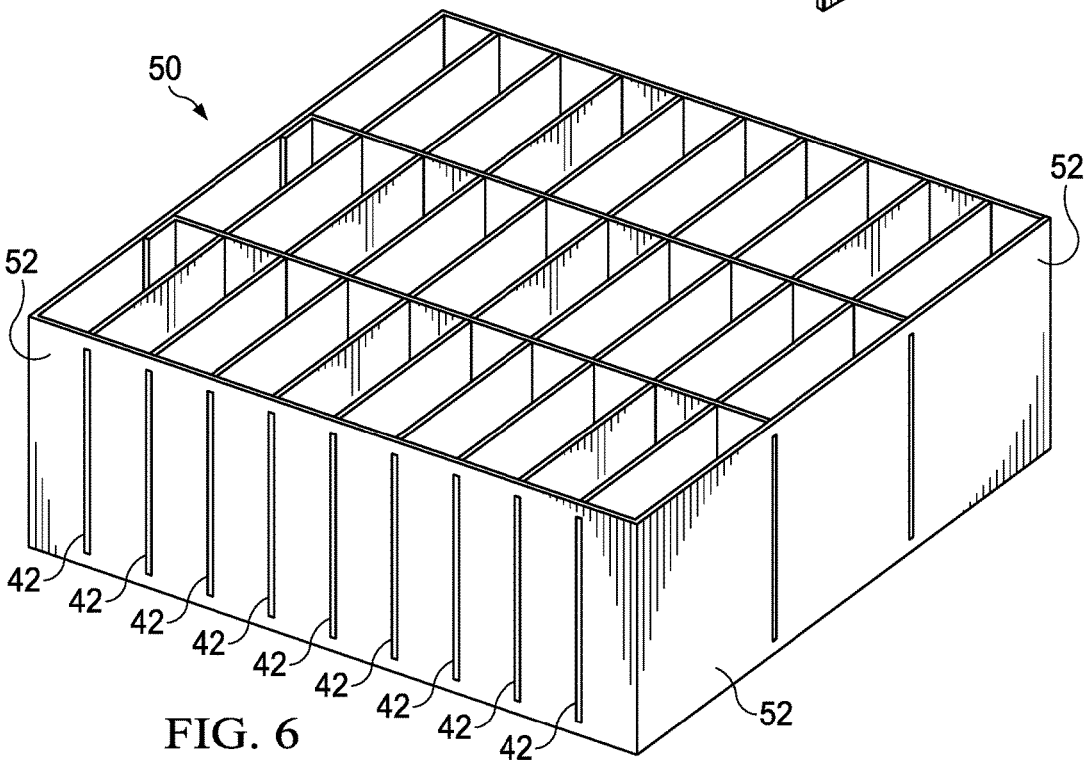
FIG. 6 is an isometric view of an embodiment of the invention without external panels formed from a plurality of longitudinal and transverse panels.

As is illustrated in FIG. 6, a divider assembly 50 may be formed from a plurality of longitudinal and transverse panels. As also illustrated an outer partition may be formed by abutting the transverse panel tabs 42 against an adjacent transverse panel bend line 44. Tape 52 or a similar material may be used to secure these tabs 42 to the adjacent panel 22.

Figure 7A:
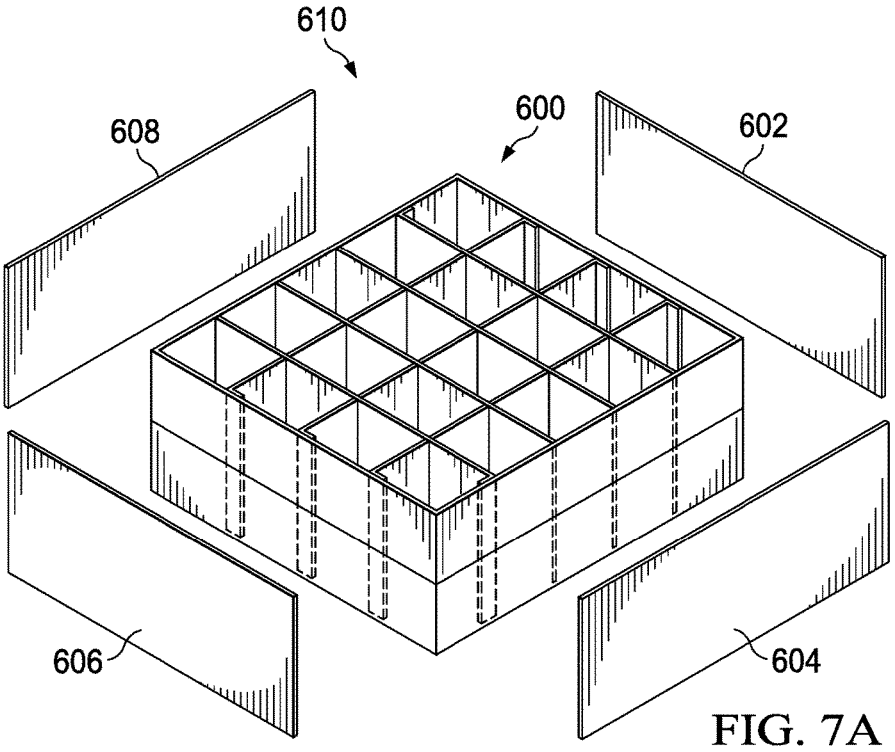
FIGS. 7A and 7B illustrate an embodiment of the invention comprising a divider box and exterior panels.
Figure 7B:
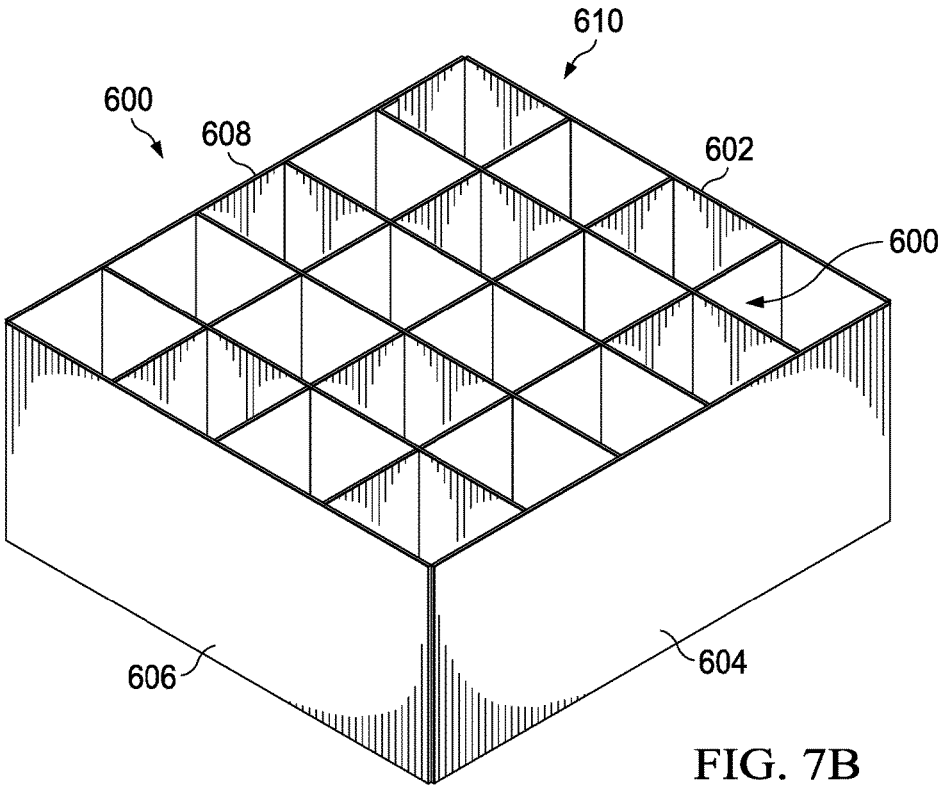

While the assembly of FIG. 6 may provide sufficient strength for many applications, additional panels may provide increased strength to resist downward forces that result from stacking or rough handling. Such an embodiment is illustrated in FIGS. 7A and 7B. As is shown, one or more divider assemblies 600 may be combined with external panels 602, 604, 606, and 608 to form a divider box 610. As is illustrated in FIG. 7B, such panels (602-608) may be affixed to the outer surfaces of the divider assembly using glue, tape, staples, or similar methods of affixing the external panels to the divider assembly. In certain embodiments of the invention, the external panels may be comprised of high strength materials, including, but not limited to corrugated fiberboard, plastic sheet, corrugated plastic sheet, and wood.

Figure 8:
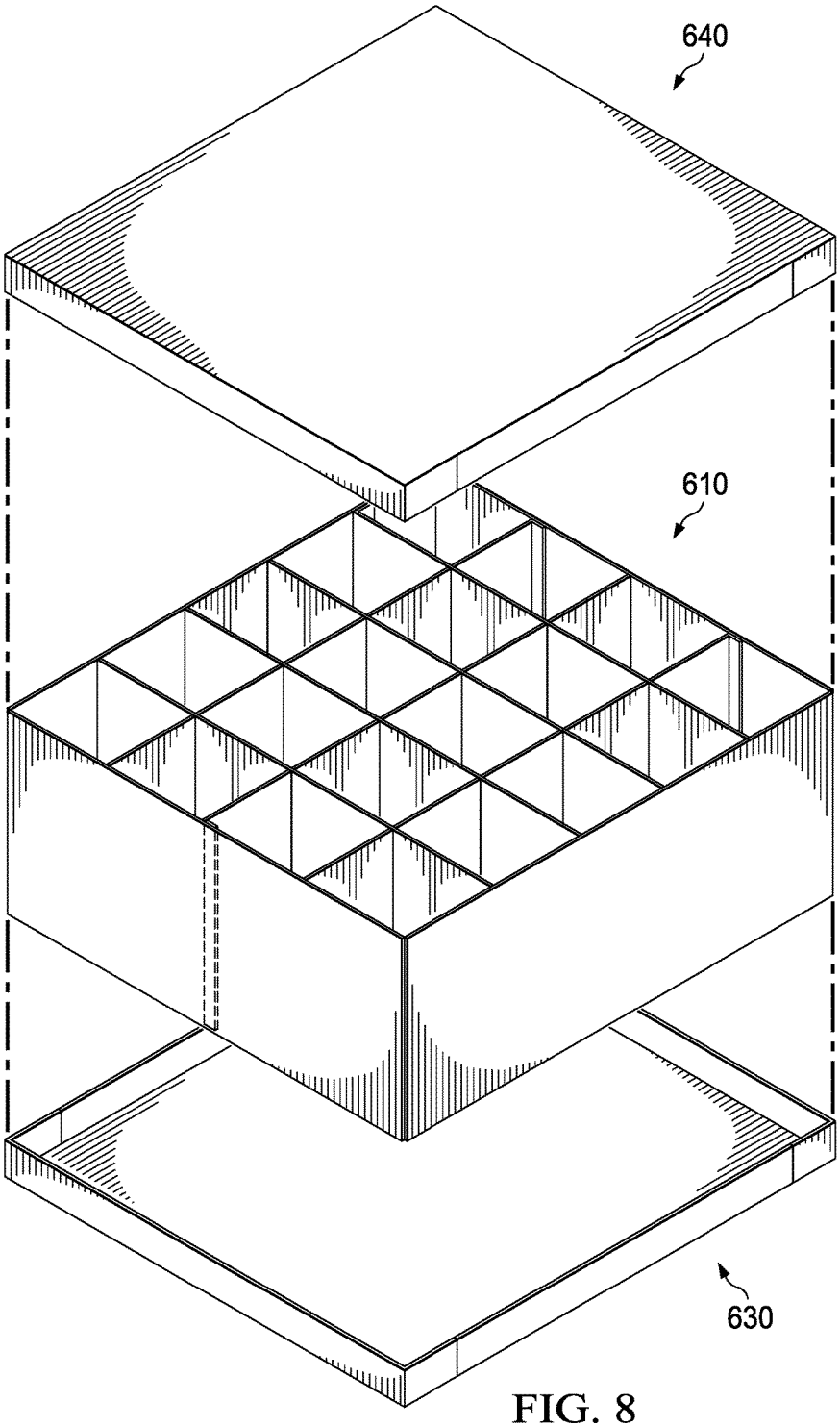
FIG. 8 is an embodiment of the invention shown with a top and bottom cover.

Referring to FIG. 8, the divider box 610 described above may be combined with a bottom cover 630 and a top cover 640 to produce a complete enclosure. In certain embodiments, the top or bottom cover may be affixed to the divider box to provide additional strength and resistance to deformation of the divider box.

Figure 9:
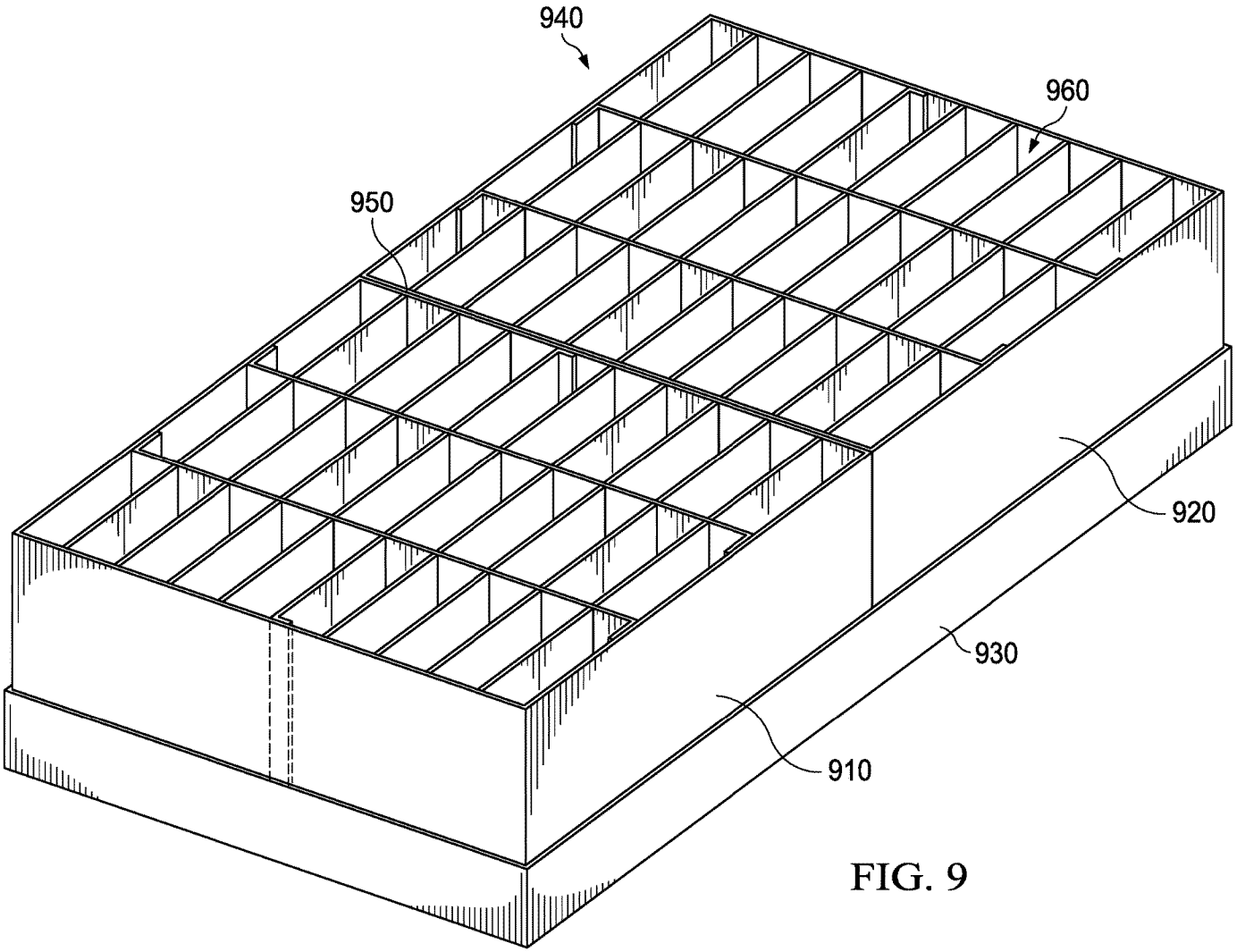
FIG. 9 is an embodiment of the invention illustrating a plurality of divider boxes assembled together with a bottom cover.

In circumstances in which additional structural strength is required, an embodiment of the invention may comprise a plurality of divider boxes 610 formed from divider assemblies 600 and exterior panels (602-608). Such an embodiment is illustrated in FIG. 9, where a first divider box 910 and second divider box 920 may be placed on a bottom cover 930 to form a divider box assembly 940. Such an assembly may be comprised of a number of divider boxes where additional strength may be obtained as the result of the additional strength provided by external panels of each divider box forming internal partitions of the divider box assembly. An example of such an internal partition is shown at 950. As an example, four divider boxes may combined to produce an additional strength partition between each box. The result may be a divider box assembly that has increased resistance to forces exerted by the stacking of multiple boxes. In such embodiments, the number of longitudinal panels 24 and transverse panels 22 may be reduced to produce fewer compartments 960. As a result, more divider boxes 902 may be required to produce the same number of compartments. The result would be a greater number of higher strength internal partitions 950 resulting in a divider box assembly 940 that has a much greater resistance to forces exerted by the stacking of divider boxes with a relatively small increase in weight and size of the divider box assembly 940.

Materials of construction for forming the divider boxes can be a paperboard or corrugated paperboard material, such as, for example, cardboard, pasteboard, fiberboard, corrugated plastic sheets, or the like. However, any material having the necessary strength and rigidity for the particular application envisioned is suitable. As to the preferred paperboard materials, it will be appreciated that the wall construction thereof, i.e., single-ply, double-ply, or higher, may be varied depending upon the application. The divider boxes and divider box assemblies will be described in particular reference to the use of corrugated paperboard; however, such description is illustrative and not a limitation on the present disclosure.

While the divider boxes have been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the divider box not be limited to the particular embodiments disclosed. Also, all citations referred herein are expressly incorporated herein by reference.

What is claimed is:

1. A divider box assembly containing a plurality of individual components, which comprises:

a series of substantially parallel transverse panels, each transverse panel having a top edge, a bottom edge, and a pair of side edges, said transverse panels having a series of slots extending from said bottom edge of each transverse panel upwardly, each transverse panel having a folded tab at each said side edge thereof;

a series of substantially parallel longitudinal panels, each longitudinal panel having a top edge, a bottom edge, and a pair of side edges, said transverse panels having a series of slots extending from said top edge of each transverse panel downwardly, each longitudinal panel having a folded tab at each side edge thereof;

said transverse panels and said longitudinal panels being perpendicularly disposed with said transverse panel slots being placed within said longitudinal panel slots to create a crate of individual compartments;

said folded tabs of each said transverse panels being positioned such that an edge of each folded tab abuts an adjacent transverse panel at a fold line of said adjacent transverse panel;

a securing material applied to each folded tab of each said transverse panel that overlaps at least a portion of a folded tab of said adjacent transverse panel.

2. The divider box assembly of claim 1, further comprising:

a plurality of exterior panels, at least one exterior panel affixed to said tabs at a first end of said transverse panels, at least one exterior panel affixed to said tabs at a second end of said transverse panels.

3. The divider box assembly of claim 1, wherein said securing material is an adhesive tape.

4. A divider box assembly comprising:

a plurality of the divider box assemblies of claim 2 where at least one exterior panel of each of said divider box assemblies is affixed to an exterior panel of another divider box assembly; and a bottom cover that covers an open end of said plurality of divider box assemblies of claim 1.

5. A method of making a divider box assembly comprising the steps of:

arranging a plurality of parallel transverse panels, each comprising a plurality of slots extending from a lower edge and further comprising a first tab located at a first end of such transverse panel and a second tab located at a second end of said transverse panel, with a plurality of longitudinal panels, each with a plurality of slots extending downward from an upper edge and further comprising a first tab located at a first end of such longitudinal panel and a second tab located at a second end of said longitudinal panel, such that said transverse panels are positioned perpendicularly and interlocking said longitudinal panels at each of said slots;

arranging said tabs of each said transverse panels such that each tab is positioned such that an edge of such tab abuts an adjacent transverse panel at a fold line of said adjacent transverse panel;

applying a securing material to each tab of each said transverse panel that overlaps at least a portion of a tab of said adjacent transverse panel;

arranging at least a first exterior end panel such that it is in contact with each of the plurality of first tabs of said transverse panels;

affixing said plurality of first tabs of said transverse panels to said first end exterior panel;

arranging at least a second end exterior panel such that it is in contact with each of the plurality of second tabs of said transverse panels;

affixing said plurality of second tabs of said transverse panel to said second end exterior panel;

arranging at least a first exterior side panel such that it is in contact with each of the plurality of first tabs of said longitudinal panels;

affixing said plurality of first tabs of said longitudinal panels to said first side exterior panel;

arranging at least a second exterior side panel such that it is in contact with each of the plurality of second tabs of said longitudinal panels; and affixing said plurality of second tabs of said longitudinal panels to said second exterior side panel.

6. The method of making a divider box assembly of claim 5, wherein said securing material is an adhesive tape.

* * * * *